United States Patent [19]

Peabody et al.

[11] Patent Number: 4,936,583

[45] Date of Patent: Jun. 26, 1990

[54] GOLF PUTTING PRACTICE AID

[76] Inventors: Dean Peabody, 12 Manor Ct., Taylorville, Ill. 62568; Edward Mauro, 4090 Daventry La., Palm Harbor, Fla. 34685

[21] Appl. No.: 420,782

[22] Filed: Oct. 12, 1989

[51] Int. Cl.[5] ..... A63B 69/36

[52] U.S. Cl. ..... 273/177 R; 273/409; 273/127 B

[58] Field of Search ..... 273/177 R, 409, 176 L, 273/176 J, 176 B, 183 E, 184 A, 185 R, 180, 408, 127 R, 127 B

[56] References Cited

U.S. PATENT DOCUMENTS

| | | | |
|---|---|---|---|
| 1,619,580 | 3/1927 | Long | 273/177 A |
| 2,417,451 | 3/1947 | Schaffner | 273/409 |
| 2,737,392 | 3/1956 | Stokes | 273/177 A |
| 4,505,478 | 3/1985 | Riethmiller | 273/176 L |
| 4,560,167 | 12/1985 | Perreau et al. | 273/177 R |

FOREIGN PATENT DOCUMENTS

| | | | |
|---|---|---|---|
| 609428 | 11/1960 | Canada | 273/177 R |

*Primary Examiner*—George J. Marlo

*Attorney, Agent, or Firm*—Joseph C. Mason; Ronald E. Smith

[57] ABSTRACT

A flat sheet of material of nominal thickness bears an actual size photograph of a golf hole on a first side as the hole appears from a distance such as three feet when viewed by a golfer of average height. The reverse side of the flat sheet of material bears an actual size photograph of a golf hole as the hole appears from a distance such as ten feet when viewed by a golfer of the same height. Other embodiments provide photographs of actual golf holes from different distances and from different heights. The device enhances the transferability of skills acquired during indoor practice sessions to real life golf courses because the practice device precisely simulates the appearance of golf holes on real golf courses.

9 Claims, 2 Drawing Sheets

GOLF PUTTING PRACTICE AID

TECHNICAL FIELD

This invention relates, generally, to a device that enables golfers to improve their putting game. More particularly, it relates to a device that simulates the appearance of a golf hole from preselected distances.

BACKGROUND ART

As every golfer knows, putting is the most difficult part of the game.

Many inventors have developed putting aids. Examples of many different types of putting aids are found in U.S. Pat. Nos. Des. 12,905; Des. 83,178; Des. 199,575; Des. 136,173; Des. 204,891; Des. 219,391; Des. 211,651; 957,387; 1,338,963; 1,615,982; 2,836,422; 3,048,405; 3,081,090; 3,086,779; 3,820,786; 4,505,478 and 4,783,071.

More particularly, Schmermund U.S. Pat. Nos. Des. 83,178, Crupi Des. 199,575 and Posnick Des. 219,391 are representative of the large body of art showing designs for golf game boards. Schermund No. '178 illustrates a game board of negligible thickness.

Candor U.S. Pat. No. 3,820,786 is of interest since it discloses page means of no substantial thickness showing two different views of golf holes respectively on opposite sides thereof.

Riethmiller U.S. Pat. No. 4,505,478 is also of interest, since it discloses an embodiment consisting of an actual photograph.

The other patents mentioned above are also of interest for their disclosures relating to golf games, putting, simulated golf holes, putting targets, and distance measuring graphics.

Some of the most difficult putts are those putts from three feet. Another difficult putt is the ten foot putt. None of the inventions heretofore developed are specifically designed to help golfers practice these difficult putts. Instead, all of the known putting aids are quite generic in their application, i.e., the golfer can practice putting while positioned any desired distance from the putting aid, but the devices heretofore known simply do not give the golfer the type of simulation of real life that can be carried over from the living room to the golf course.

Moreover, the prior art taken as a whole, vast as it is, neither teaches nor suggests a device that simulates the actual appearance of a real golf hole on a real golf course.

DISCLOSURE OF INVENTION

The present invention is provided in the form of a flat sheet of material that has a first photograph on a first side thereof and a second photograph on a second side thereof.

The sheet of material is preferably circular in configuration and is about eleven and one-half inches in diameter. On a first side thereof, a photograph of an actual golf hole on a green is provided in actual size. The photo is taken from the vantage point of the eyes of a golfer of average height from a distance of three feet from the cup. Thus, when the golfer desires to practice the three foot putt, he or she places the device bearing the photograph on the floor of an office or living room, e.g., and stands three feet therefrom. From that position, the golf hole will appear just as it would on an actual golf course.

To practice a ten foot putt, the golfer simply flips the device over and stands ten feet therefrom. A photograph on the second side of the sheet of material shows an actual size golf hole as it would appear from ten feet away.

Additional photographs may be provided on additional devices to show what a five foot or twelve foot putt looks like, and so on. The invention is not limited to any particular putting distance, as pointed out in the claims that follow. Moreover, the photographs may be made from the eye heights of golfers of varying heights. All of the photographs are of the highest professional quality and as such provide excellent perspective views in fine detail.

The primary object of this invention is to provide a golf putting aid that enables the golfer to carry skills acquired indoors to an actual golf course.

The invention accordingly comprises the features of construction, combination of elements and arrangement of parts that will be exemplified in the construction set forth hereinafter and the scope of the invention will be set forth in the claims.

DESCRIPTION OF THE DRAWINGS

For a fuller understanding of the nature and objects of the invention, reference should be made to the following detailed description, taken in connection with the accompanying drawings, in which.

BEST MODES FOR CARRYING OUT THE INVENTION

Figure 1:
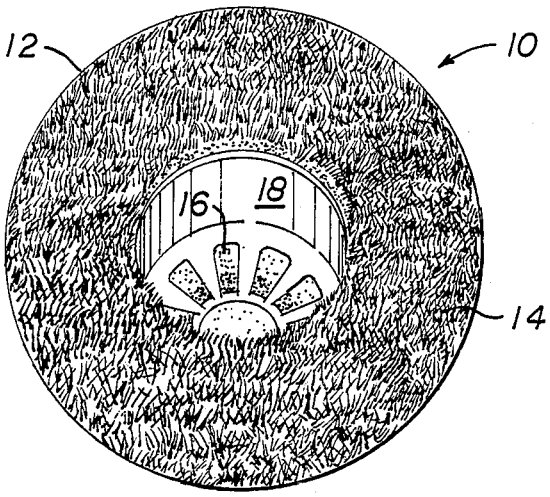
FIG. 1 is a top plan view of an illustrative embodiment of the invention.

Referring now to the drawings, it will there be seen that an illustrative embodiment of the invention is denoted as a whole by the reference numeral 10.

Device 10 is shown in a preferred circular configuration, but the device, known commercially as the "TRU-VIEW," (trademark) may take any preselected geometrical configuration, such as square, triangular, hexagonal or the like.

Device 10 includes a core 12 of nominal thickness upon which photograph 14 is permanently mounted. The TRU-VIEW is specially laminated. The laminate makes the TRU-VIEW water proof and keeps it clean. Moreover, the lamination helps keep the TRU-VIEW flat if it is bent. Photograph 14 is an actual size photograph of an actual golf hole 16, showing cup 18 therein, taken three feet from the hole from a height that corresponds to the eye level of a golfer of average height. Similar views may be taken from the same distance at different heights to provide a three foot putting aid for golfers of varying heights.

A hole 16 also appears in actual size photograph 20 which is on the reverse side of device 10. This photograph 20 shows hole 16 having cup 18 from ten feet away, again at the eye level of a golfer of average height.

In a commercial embodiment of the TRU-VIEW, the diameter of device 10 is eleven and one-half inches. Thus, a larger amount of grass surrounds the hole 16 than is depicted.

Figure 2:
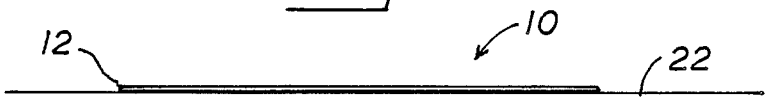
FIG. 2 is a side elevational view of said embodiment.
Figure 3:
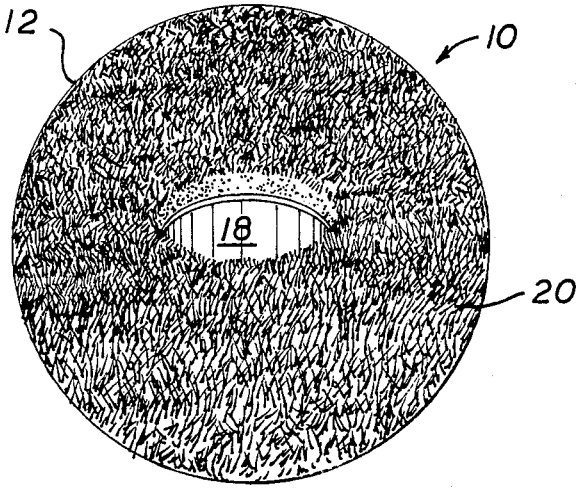
FIG. 3 is a top plan view of the second side of the embodiment of FIG. 1.
Figure 4:
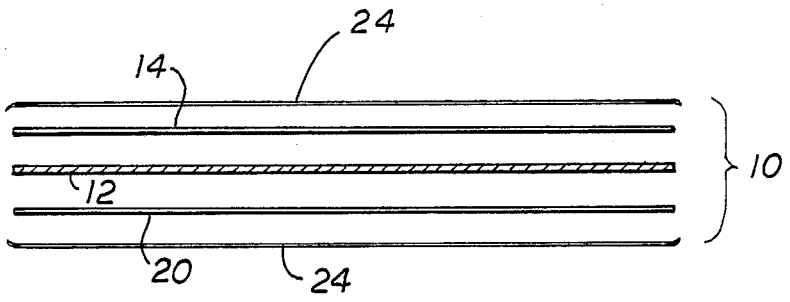

A golfer who practices putting with device 10 will concentrate intently on hole 16 and cup 18, and his or her peripheral vision will also see the large annular band of grass surrounding the hole. When device 10 is placed on a carpeted or wooden floor 22, (FIG. 2), intense concentration on the device causes the mind to block out everything but device 10. Thus, when the golfer is on a real golf course and is three feet or ten feet away from the hole, the actual view of the hole will conjure up the memories of past practice sessions since the view in real life will be exactly the same as was the view in said practice sessions.

The TRU-VIEW has been known to establish minds-eye retention. After viewing a picture of the golf hole, the mind records the image and retains it. When the eye views the hole again (at the golf course), the mind recalls what it had seen previously and directs the muscles accordingly. Muscle memory then comes into play to help the golfer make a better putt.

Accordingly, the practice aid allows skills learned in practice to be transferable to the real world. This invention thus sharply contrasts with the devices of the prior art which do not simulate the real world and thus which do not teach skills transferable from the home to the golf course.

This invention pioneers the art of practice aids that simulate the real world to enhance the transferability of practice-acquired skills to the real world. As such, it is not limited to golf putting aids but has applicability to other fields of athletic and non-athletic endeavor as well. Accordingly, the claims that follow are to be broadly interpreted as a matter of law.

It will thus be seen that the objects set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A putting aid for golfers, comprising:

a flat sheet of material of predetermined configuration and of predetermined dimension;

a first photograph of a preselected scene being disposed in overlying relation to a first side of said sheet of material;

said scene including a golf hole having a size which produces an image equal to that which would be seen by a standing golfer viewing at eye level a hole being putted on a real outdoor golf green from a first predetermined putting distance.

whereby putting skills may be acquired during practice sessions by putting a golf ball at said photograph and be transferred to said real green

2. The putting aid of claim 1 further comprising:

a second photograph of a preselected scene being disposed in overlying relation to a second side of said sheet of material;

said scene being a golf hole as viewed from a second predetermined distance.

3. The putting aid of claim 2, wherein said first and second photographs include a view of grass surrounding said golf hole.

4. The putting aid of claim 3, wherein said first predetermined distance is three feet and the second predetermined distance is ten feet.

5. The putting aid of claim 3, wherein said first predetermined distance is five feet and the second predetermined distance is twelve feet.

6. The putting aid of claim 3, wherein said predetermined configuration is circular.

7. The putting aid of claim 6, wherein said sheet of material is eleven and one-half inches in diameter.

8. The putting aid of claim 1, wherein said flat sheet of material is covered on both sides thereof with a laminate.

9. The putting aid of claim 8, wherein said flat sheet of material is waterproof.

* * * * *